US008241157B2

(12) United States Patent
Russell et al.

(10) Patent No.: US 8,241,157 B2
(45) Date of Patent: Aug. 14, 2012

(54) PROJECTILE IMPACT SYSTEM

(76) Inventors: Scott Russell, Powder Springs, GA (US); Jeff Price, Monroe, GA (US)

( * ) Notice: Subject to any disclaimer, the term of this patent is extended or adjusted under 35 U.S.C. 154(b) by 0 days.

(21) Appl. No.: 12/979,936

(22) Filed: Dec. 28, 2010

(65) Prior Publication Data

US 2011/0160010 A1 Jun. 30, 2011

Related U.S. Application Data

(60) Provisional application No. 61/290,276, filed on Dec. 28, 2009.

(51) Int. Cl.
*F42B 6/04* (2006.01)

(52) U.S. Cl. ..... 473/578

(58) Field of Classification Search ..... 473/578, 473/583, 585

See application file for complete search history.

(56) References Cited

U.S. PATENT DOCUMENTS

| | | | | |
|---|---|---|---|---|
| 4,900,038 | A * | 2/1990 | Czetto et al. | 473/570 |
| 6,375,586 | B1 * | 4/2002 | Cousins et al. | 473/578 |
| 6,558,280 | B1 * | 5/2003 | Kuhn | 473/578 |
| 2006/0154756 | A1 * | 7/2006 | Shao | 473/578 |
| 2008/0051231 | A1 * | 2/2008 | Everett | 473/578 |

* cited by examiner

*Primary Examiner* — John Ricci
(74) *Attorney, Agent, or Firm* — Dinsmore & Shohl

(57) ABSTRACT

Embodiments included herein include a projectile system. At least one embodiment of the a projectile system includes hollow portion and a weight that is movably secured within the hollow portion of the projectile insert system. Some embodiments include an attracting device rigidly secured at a first end of the hollow portion, the attracting device removably securing the weight, where the hollow portion provides a pathway for the weight to travel when a force is exerted on the projectile insert system that causes the weight to become unsecured from the attracting device.

19 Claims, 3 Drawing Sheets

PROJECTILE IMPACT SYSTEM

CROSS REFERENCE

This application claims priority to U.S. Provisional Application No. 61/290,276, filed Dec. 28, 2009, entitled "Arrow Impact System," which is hereby incorporated by reference in its entirety.

BACKGROUND

With bow and other types hunting, a hunter oftentimes needs to be very accurate with the impact position of a shot. More specifically, as arrows and other projectiles are less lethal than other weaponry, a bow shot oftentimes must strike the target animal in a certain location to ensure a pass through shot that creates enough trauma to ensure death, minimize suffering, and reduce a distance the animal runs before death.

SUMMARY

Embodiments included herein include a projectile system. At least one embodiment of a projectile system includes hollow portion and a weight that is movably secured within the hollow portion of the projectile insert system. Some embodiments include an attracting device rigidly secured at a first end of the hollow portion, the attracting device removably securing the weight, where the hollow portion provides a pathway for the weight to travel when a force is exerted on the projectile insert system that causes the weight to become unsecured from the attracting device.

Other embodiments and/or advantages of this disclosure will be or may become apparent to one with skill in the art upon examination of the following drawings and detailed description. It is intended that all such additional systems, methods, features, and advantages be included within this description and be within the scope of the present disclosure.

BRIEF DESCRIPTION

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Embodiments disclosed herein include systems for an arrow attachment. In some embodiments, the arrow attachment is integral to the arrow, while in some embodiments the arrow attachment is detachable from the arrow. Regardless, embodiments disclosed herein include a weight that is disposed within the arrow attachment that is free to move along the length of the arrow attachment. Also included is a magnet or other attracting device for attracting and/or removably securing the weight. Another attracting device may also be disposed within the projectile insert system, toward a tail area, such that when the arrow strikes a target, the inertia from the weight will force the weight off the attracting device, toward an arrowhead area. When the weight strikes the arrowhead area, additional force is provided for the arrow, thereby improving the effectiveness of the arrow. Other embodiments are also disclosed, as indicated below.

Figure 1:
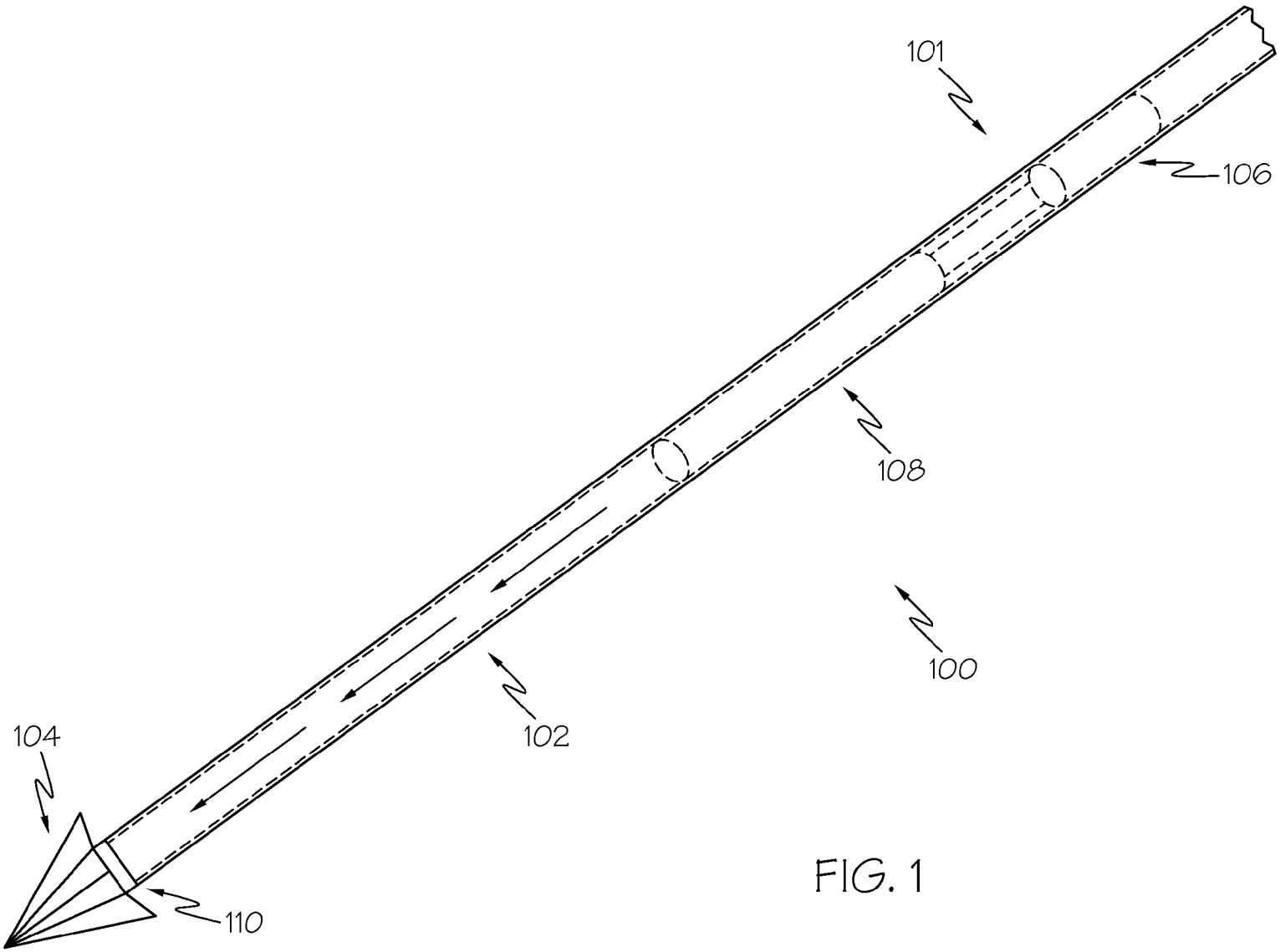
FIG. 1 depicts an embodiment of an arrow system, according to embodiments disclosed herein.

Referring now to the drawings, FIG. 1 illustrates an embodiment of a projectile system 100. As illustrated, the projectile system 100 includes an arrow shaft 101 and an arrowhead 104. The arrow shaft 101 includes an insert system 102 that may define a hollow portion within which an attracting device 106 and a weight 108 may reside. The weight 108 may be configured to traverse a pathway defined by the hollow portion of the projectile insert system 102 to a broad head insert reinforcement 110. The broad head insert reinforcement 110 provides stability to prevent damage to the projectile system 100 after the weight 108 strikes the target.

The weight 108 may be made of any material that can be removably connected and/or attracted to the attracting device 106 and may be a one piece component or a multi-piece component (such as a hollow weight with bead weights inside, a slotted weight, a fluted weight, etc.). The materials that may be used for the weight 108 include lead, aluminum, and/or other metals and nonmetals.

Similarly, the attracting device 106 may include a magnet and/or other device for attracting and/or removably securing the weight 108. The attracting device 106 may be fixed at a predetermined distance from the broad head insert reinforcement 110. The attracting device 106 may be composed of any of a plurality of materials (e.g., natural magnets, synthetic magnets, adhesive materials, etc.) that attracts and/or otherwise removably secures the weight 108. The position of the attracting device 106 may be determined based on the weight of the arrow (or other projectile), characteristics of the bow that will shoot the arrow, type of game, and/or other criteria. Similarly, the strength and weight of the attracting device 106 may be determined based on similar factors.

Further, the weight 108 may be configured to traverse the length of the arrow shaft between the attracting device 106 and the broad head insert reinforcement 110. The attracting device 106 may be located such that a user can position the arrow with the arrowhead 104 pointing upward to set the weight 108 to attach to the attracting device 106. The user may then fire the arrow (using a bow or other similar device). The weight 108 may be configured to stay attached to the attracting device 106 until the arrow impacts a target. At impact, the velocity of the arrow will significantly decrease.

According to that change in velocity, the momentum of the weight 108 will be great enough to overcome the force that keeps the weight 108 attached to the attracting device 106. The weight 108 may then continue to move along the length of the projectile insert system 102 until the weight 108 strikes the broad head insert reinforcement 110. When the weight 108 strikes the broad head insert reinforcement 110, the force of the weight 108 may further provide force to the projectile system 100 as a whole to force the arrowhead completely through the target. Use of the attracting device 106 and weight 108 in this manner allows a hunter greater freedom from less lethal, penetrating, and/or missed shots, as well as provide a more humane demise to the target animal.

Additionally, in some embodiments, a tube or sleeve made of aluminum, plastic, and/or other material may be inserted and/or bonded to the inner wall of the projectile system 100 between the attracting device 106 and the broad head insert reinforcement 110 to reinforce the inner wall of the arrow for the length of travel of the moveable weight. Such reinforcement may reduce wear that can occur when the weight 108 repeatedly travels within the projectile insert system 102.

One should note that in some embodiments, the projectile system 100 of FIG. 1 may be configured with insulation to reduce noise created by the motion of the weight 108. The insulation may be attached to the broad head insert reinforcement 110 and/or at other areas of the projectile system 100. Similarly, some embodiments may be configured with the stopper also being constructed of magnetic material that is attached at the broad head insert reinforcement 110. Accordingly, the attraction of the stopper with the weight 108 may further increase the momentum of the weight 108 relative to the projectile insert system 102 at impact, thereby creating a greater force for the arrow to cleanly exit the target animal.

Additionally, while some embodiments include an attracting device 106 that is fixed, some embodiments may be configured where the weight 108 is fixed and the attracting device 106 traverses the hollow portion of the projectile insert system 102. Further, while some embodiments may be user-configurable, some embodiments may be configured with the attracting device 106 and weight 108 permanently positioned inside the projectile insert system 102, such that a user may not have access. Similarly, while the embodiments of the projectile system discussed herein relate to arrows, some embodiments may be applied to spears, harpoons, bullets, and/or other projectiles.

Figure 2A:
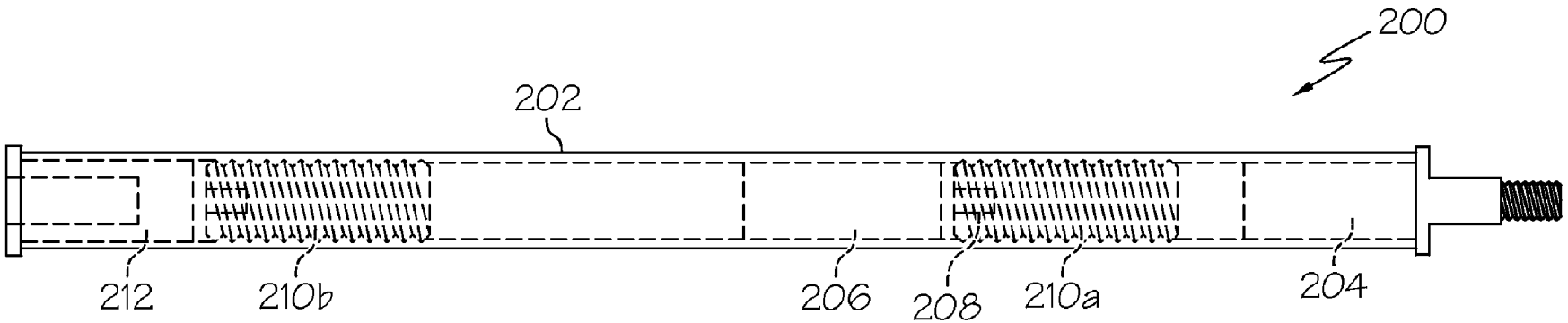
FIGS. 2A and 2B depict an embodiment of an arrow system insert for a screw-type attachment, according to embodiments disclosed herein.
Figure 2B:
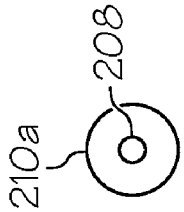

FIGS. 2A and 2B depict an embodiment of an arrow system insert 200 for a screw-type attachment, according to embodiments disclosed herein. As illustrated in FIG. 2A, the arrow system insert 200 may be configured for removable attachment to an arrow and arrowhead. The arrow system insert 200 may include a shaft component 202, as well as a threaded shaft receiving component 204, a weight 206, an attracting device 208, a plurality of padding inserts 210*a*, 210*b*, and a threaded arrowhead receiving component 212. The weight 206 may reside within the arrow system insert 200 and may be unobstructed to move between the first padding insert 210*a* and the second padding insert 210*b*. Included within the first padding insert is the attracting device 208. The first padding insert 210*a* may be secured within the shaft component 202 and may be secured in place within the shaft component 202. Such that when the weight 206 contacts the attracting device 208 and the first padding insert 210*a*, the padding insert 210*a* does not move relative to the rest of the arrow system insert 200. While the plurality of padding inserts 210*a*, 210*b* may be constructed of nylon, other materials may be utilized to absorb the impact of the weight 206 and stabilize the shaft component 202. The padding insert 210*a* is configured to absorb rearward impact and provide a sufficient mechanism for holding the attracting device 208. The padding inserts 210*a*, 210*b*, may be construed of any synthetic and/or metallic material.

Also included are the threaded shaft receiving component 204 and the threaded arrowhead receiving component 212. The threaded shaft receiving component 204 may be configured to removably receive a standard arrow shaft via a threaded screwing mechanism. Similarly, an arrowhead may be received by the threaded arrowhead receiving component 212.

It should be understood that while the threaded shaft receiving component 204 and the threaded arrowhead receiving component 212 may be threaded and configured to receive a corresponding threaded portion of an arrow shaft and arrowhead respectively, these are merely examples, as any mechanism for securing the arrowhead and the arrow shaft may be utilized.

It should be understood that, while other parameters may be utilized, in some embodiments of an arrow projectile, the weight 206 may have a length from about ¼ inches to about 2 inches, and in some embodiments the length may be about 1½ inches. Similarly, the weight 206 may have a diameter from 1/16 inches to about ½ inches and in some embodiments of the arrow projectile, the diameter may be about 15/32 inches. In some embodiments of the arrow projectile, the distance between the padding inserts 210*a*, 210*b* may have a length equal to the length of the weight 206, plus from about ⅛ inches to about 15 inches (or half the length of the projectile). In some embodiments of an arrow projectile, this length is the length of the weight 206, plus 1½ inches. Further, in some embodiments of an arrow projectile, the attracting device 208 may have a length from about 1/32 inches to about ½ inches and a diameter (or width) from about 1/32 inches to about ½ inches. However, regardless of the dimensions of the weight 206 and the attracting device 208, the mass of the weight 206 may be from about 5 grains to about 1000 grains (in some embodiments from about 150 grains to about 200 grains). The attracting device 208 may have a strength from about 0 pounds to about ½ pounds and in some embodiments about ⅛ pounds. Similarly, the thread size of the arrow system insert 200 may be about ¼-20 thread and may have a length of about 1 inches for embodiments of an arrow projectile.

It should be understood that the dimensions discussed above are merely examples, as other dimensions may be utilized for performing the intended function. Similarly, as other types of projectiles may have dimensions that are substantially different than those of an arrow projectile, the ranges provided above may be proportionally different, based on the speed, size, and weight of the projectile.

FIG. 2B further depicts the first padding insert 210*a* and the attracting device 208 from a different perspective. It should be understood that the first padding insert 210*a* may be of any shape, but as illustrated in FIG. 2B, may be cylindrical in shape. Additionally the attracting device 208 may be removably or non-removably secured within the first padding insert 210*a*, such that the attracting device 208 is positioned to attract and/or secure the weight 206.

Figure 3:
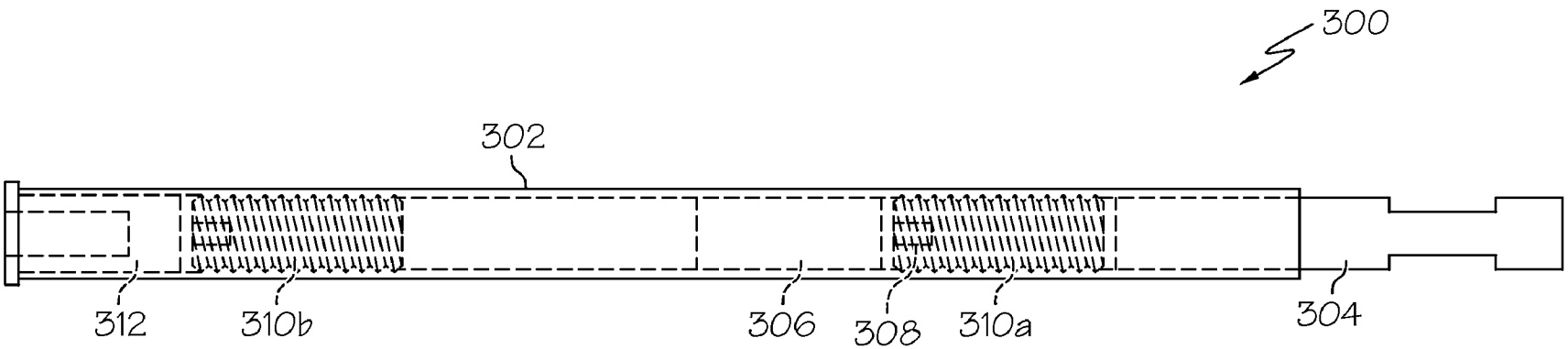
FIG. 3 depicts an embodiment of an arrow system insert for an adhesive-type attachment.

FIG. 3 depicts an embodiment of an arrow system insert 300 for an adhesive-type attachment. As illustrated, the embodiment of FIG. 3 the arrow system insert 300 may include a shaft component 302. The shaft component 302 may be coupled to and/or include an adhesive shaft receiving component 304, a weight 306, an attracting device 308, a plurality of padding inserts 310*a*, 310*b*, and an adhesive arrowhead receiving component 312. Similar to the embodiment from FIGS. 2A and 2B, the embodiment of FIG. 3 includes the adhesive shaft receiving component 304 and an adhesive arrowhead receiving component 312. The adhesive shaft receiving component 304 and an adhesive arrowhead receiving component 312 may be configured to receive an arrow shaft and arrowhead, respectively, and secure those components via an adhesive connection, frictional connection, or the like.

It should be understood that while FIGS. 2A and 2B depict utilizing only threaded components for the threaded shaft receiving component 204 and the threaded arrowhead receiving component 212 and FIG. 3 depicts utilizing only adhesive components for the adhesive shaft receiving component 304 and the adhesive arrowhead receiving component 312, these are merely examples. In some embodiments, a threaded component may be utilized for the shaft receiving component and an adhesive component may be utilized for the arrowhead receiving component (or vice versa). Similarly, other components may also be used.

One should also note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of this disclosure. Many variations and modifications may be made to the above-described embodiment(s) without departing substantially from the spirit and principles of the disclosure. Further, the scope of the present disclosure is intended to cover all combinations and sub-combinations of all elements, features, and aspects discussed above. All such modifications and variations are intended to be included herein within the scope of this disclosure.

Therefore, at least the following is claimed:

1. A projectile system, comprising:

an arrowhead;

an arrow shaft; that includes a projectile insert structure, the projectile insert structure comprising:

a hollow portion that is coupled to an aluminum sleeve, wherein the aluminum sleeve is coupled to an interior portion of the hollow portion, wherein the aluminum sleeves reduces wear to the hollow portion;

a weight constructed with a predetermined weight length, wherein the weight is movably secured within the hollow portion of the projectile insert system, wherein the weight has a mass from about 5 grains to about 1000 grains;

a first padding insert rigidly secured at a first end of the hollow portion, wherein the first padding insert includes a first distal end adjacent to an arrowhead and a first proximal end opposite the first distal end, and wherein the first padding insert is constructed of nylon;

a second padding insert rigidly secured at a second end of the hollow portion to absorb an impact of the weight after the weight traverses the hollow portion, wherein the second padding insert includes a second distal end adjacent to the arrowhead and a second proximal end opposite the second distal end, and wherein the second padding insert is constructed of nylon;

a first magnet rigidly secured within the first distal end to protect the first magnet from the impact of the weight, the first magnet removably securing the weight; and a second magnet rigidly secured within the second proximal end to protect the second magnet from the impact of the weight, the second magnet removably securing the weight, wherein the first padding insert and the second padding insert are separated by a predetermined distance, the predetermined distance being equal to the predetermined weight length plus an additional length that ranges from about ⅛ inches to about 15 inches, wherein the hollow portion provides a pathway for the weight to travel toward the second end of the hollow portion when a force is exerted on the projectile insert structure that causes the weight to become unsecured from the first magnet.

2. The projectile system of claim 1, further comprising a broad head insert reinforcement rigidly secured at the second end of the hollow portion to provide stability to the projectile insert structure.

3. A projectile insert system, comprising:

a hollow portion;

a weight that is movably secured within the hollow portion;

a first padding insert rigidly secured at a first end of the hollow portion, wherein the first padding insert includes a first distal end adjacent to an arrowhead and a first proximal end opposite the first distal end;

a second padding insert rigidly secured at a second end of the hollow portion to absorb an impact of the weight after the weight traverses the hollow portion, wherein the second padding insert includes a second distal end adjacent to the arrowhead and a second proximal end opposite the second distal end;

a first attracting device rigidly secured within the first distal end, the first attracting device removably securing the weight; and a second attracting device rigidly secured within the second proximal end, the second attracting device removably securing the weight, wherein the hollow portion provides a pathway for the weight to travel when a force is exerted on the projectile insert system that causes the weight to become unsecured from the first attracting device.

4. The projectile insert system of claim 3, further comprising a broad head insert reinforcement rigidly secured at a second end of the hollow portion to provide stability to the projectile insert system in response to the weight being unsecured from the first attracting device.

5. The projectile insert system of claim 3, further comprising a shaft receiving component for receiving an arrow shaft.

6. The projectile insert system of claim 3, further comprising an arrowhead receiving component for receiving the arrowhead.

7. The projectile insert system of claim 3, wherein the projectile insert system is rigidly secured to at least one of the following: an arrow shaft and the arrowhead.

8. The projectile insert system of claim 3, wherein the projectile insert system is removably secured to at least one of the following: an arrow shaft and the arrowhead.

9. The projectile insert system of claim 3, wherein at least one of the following is constructed of nylon: the first padding insert and the second padding insert.

10. The projectile insert system of claim 3, wherein the first attracting device and the second attracting device each includes at least one of the following: a magnet and an adhesive.

11. The projectile insert system of claim 3, wherein the weight is constructed with a predetermined weight length.

12. The projectile insert system of claim 11, wherein the first padding insert and the second padding insert are separated by a predetermined distance, the predetermined distance being equal to the predetermined weight length plus an additional length that ranges from about ⅛ inches to about 15 inches.

13. A projectile insert system, comprising:

a hollow portion comprising a first end and a second end, wherein the second end is adjacent an arrowhead and the first end is opposite the second end;

a weight that is movably secured within the hollow portion;

a second padding insert rigidly secured at the second end;

a first attracting device rigidly secured at the first end, the first attracting device removably securing the weight; and a second attracting device rigidly secured at the second end, wherein the hollow portion provides a pathway for the weight to travel when a force is exerted on the projectile insert system that causes the weight to become unsecured from the first attracting device and become removably secured to the second attracting device.

14. The projectile insert system of claim 13, wherein the first attracting device and the second attracting device each include at least one of the following: a magnet and an adhesive.

15. The projectile insert system of claim 13, wherein the second attracting device is rigidly secured within the distal padding insert to prevent damage to the second attracting device upon impact of the weight.

16. The projectile insert system of claim 13, further comprising a first padding insert secured at a first end of the hollow portion.

17. The projectile insert system of claim 16, wherein at least one of the following is constructed of nylon: the first padding insert and the second padding insert.

18. The projectile insert system of claim 16, wherein the weight is constructed with a predetermined weight length.

19. The projectile insert system of claim 18, wherein the distal padding insert and the proximal padding insert are separated by a predetermined distance, the predetermined distance being equal to the predetermined weight length plus from about ⅛ inches to about 15 inches.

* * * * *